United States Patent [19]

Richter

[11] 4,400,835

[45] Aug. 30, 1983

[54] BATH SUPPORT

[76] Inventor: Jutta M. Richter, 2750 Wheatstone, Space #34, San Diego, Calif. 92111

[21] Appl. No.: 204,483

[22] Filed: Nov. 5, 1980

[51] Int. Cl.[3] ..... A47K 3/022

[52] U.S. Cl. ..... 4/578; 4/551; 4/546

[58] Field of Search ..... 4/661, 546, 548, 549, 4/551, 559, 571, 572, 576, 578, 577, 589, 590, 630, 654, 656, 660, 538, 531, 532, 592, 593, 604; 108/27, 48, 60, 61; 297/14

[56] References Cited

U.S. PATENT DOCUMENTS

| | | | |
|---|---|---|---|
| 424,730 | 4/1890 | Schoonmaker | 4/578 X |
| 1,115,968 | 11/1914 | Park | 4/551 |
| 1,490,028 | 4/1924 | Saver | 4/572 X |
| 1,724,479 | 8/1929 | Havener | 4/551 X |
| 1,923,482 | 8/1933 | Frankenstein | 4/572 X |
| 2,294,164 | 8/1942 | Eberle | 4/576 X |
| 2,769,984 | 11/1956 | Skirvin | 4/551 |
| 2,965,153 | 12/1960 | Purcell, Sr. | 4/578 X |
| 3,993,376 | 11/1976 | Meldahl | 4/630 X |
| 4,087,127 | 5/1978 | Lotta | 297/14 |
| 4,228,552 | 10/1980 | Weaver, Jr. | 4/576 X |

*Primary Examiner*—Charles E. Phillips
*Attorney, Agent, or Firm*—Ralph S. Branscomb

[57] ABSTRACT

A bath support or bench includes a wall cabinet for mounting on the wall of a bathroom adjacent a tub or shower and includes a wall panel or bracket, a support bench pivotally mounted to the bracket and foldable upward against the bracket, and foldable downward into support position in the bathing area, and a cover hinged to the wall panel for covering the support bench when folded upward to the out-of-the way position.

4 Claims, 8 Drawing Figures

BATH SUPPORT

BACKGROUND OF THE INVENTION

The present invention relates to bathroom fixtures and pertains particularly to a bather's support or bench for use in a tub or shower.

It is sometimes desirable to sit in an elevated position in a bath or shower during bathing. This is particularly desirable for the aged and the handicapped, and/or those who are unable to stand or who may be unsteady on their feet. A number of prior art support devices have been suggested for this purpose. These, however, have a number of objections, particularly in that they are generally complicated and expensive and do not provide the required utility.

It is therefore desirable that a simple, effective and highly functional support be available for utilization in a bathtub or shower.

SUMMARY AND OBJECTS OF THE INVENTION

It is therefore the primary object of the present invention to provide an improved support for a bathtub or shower.

In accordance with the primary aspect of the present invention, a bath support device includes a cabinet comprising a wall bracket or panel having a cover or closure pivotally mounted to the bracket and a folding support bench foldable onto the wall bracket with the cover pivotal to enclose the support. Additional features include an angled handrail secured to the cover of the cabinet.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
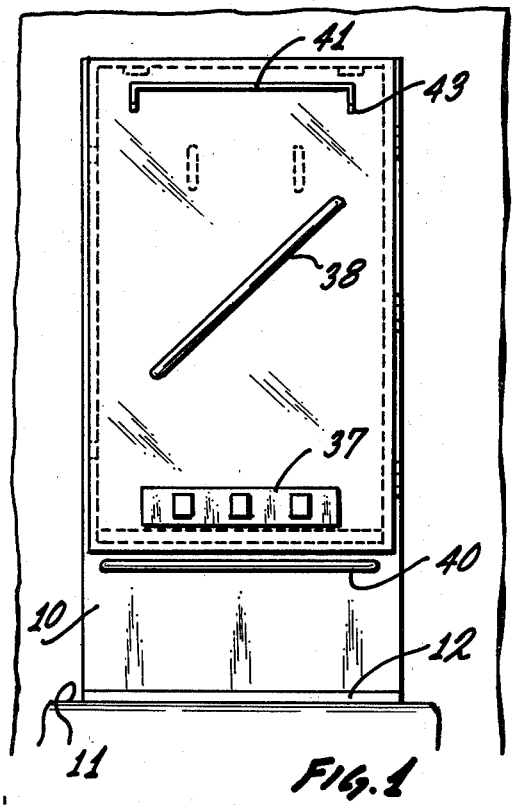
FIG. 1 is an elevational view of a support unit in accordance with the invention.

Turning to FIG. 1 of the drawings a support unit in accordance with the invention comprises a generally rectangular back or wall panel 10 which has an upper end that includes a tray or shelf and a lower end 12 that is adapted to engage or rest on the rim 11 of the wall or side of a conventional tub. The panel is adapted to be mounted directly to a wall beside a tub by means of lag bolts, screws, or the like.

Pivotally mounted directly to the back panel or bracket and closely adjacent the lower end thereof, preferably at approximately 6 inches above the edge or rim of the bathtub is a support panel or bench member

14. This member 14 is pivoted at the inner end by a piano hinge 16 to the wall panel 10 and includes an outer support end 18 which is supported by a pair of legs 20 that are pivotally attached thereto and include suction cup feet 13 at their lower end which engage the rim 15 of the side of the tub for supporting the bench or support member in a horizontal position above the bench. The support member 14 and its support 20 legs can be more securely supported by a hinged bracket 22 which are connected between the support member 14 and legs 20.

Figure 3:
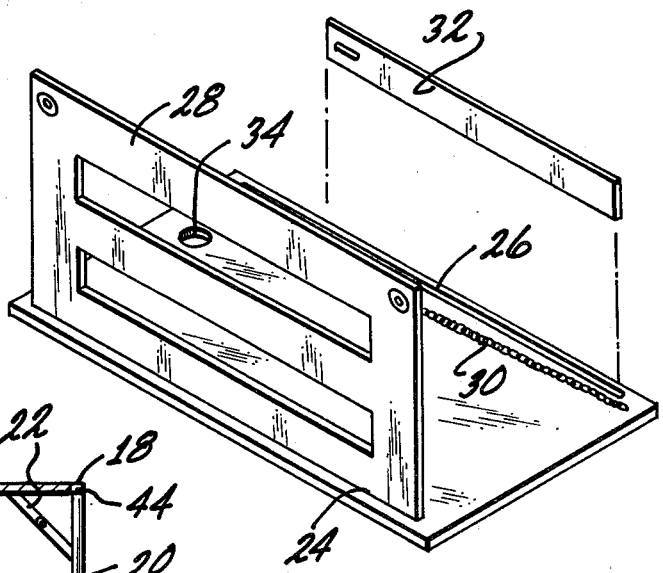
FIG. 3 is a detailed view showing additional features of the invention.

The bench or support member 14 as best seen in FIG. 3 may be designed to serve also as a table or desk and permit a party to read and write or the like while sitting in the tub. To this end, the support panel 14 is provided with a pair of slits 24 and 26 running lengthwise closely adjacent the edges thereof. These slots or slits can receive a backrest or the like 28 which can be fitted at the lower edge into the slots and include support chains, or the like 30 for connecting to the forward end of the bench or support member, such as by hooks or the like to support the weight of the bather against the back rest. Additional portions of this arrangement can include one or more panels or fence members 32, which may slide into the slots 24 and 26 in place of the back rest and prevent articles from sliding off the bench or table into the water. Additional features can include a cup well or the like 34 for receiving a coffee cup, a glass or the like.

Figure 4:
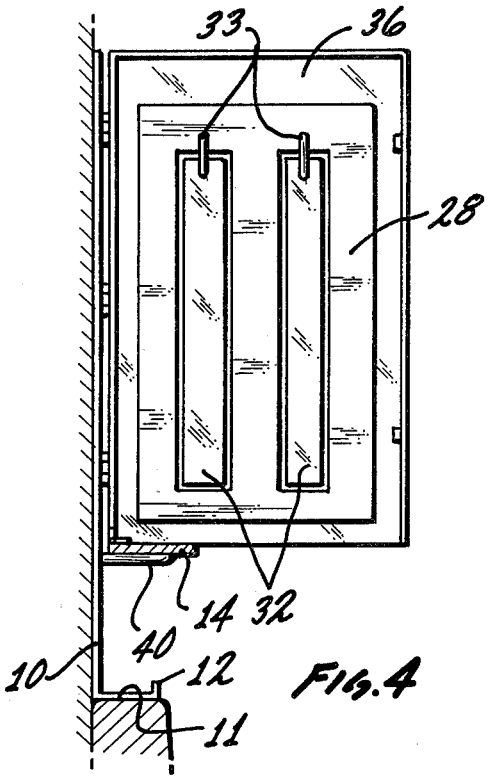
FIG. 4 is a view like FIG. 1 showing the cover in the open position.
Figure 2:
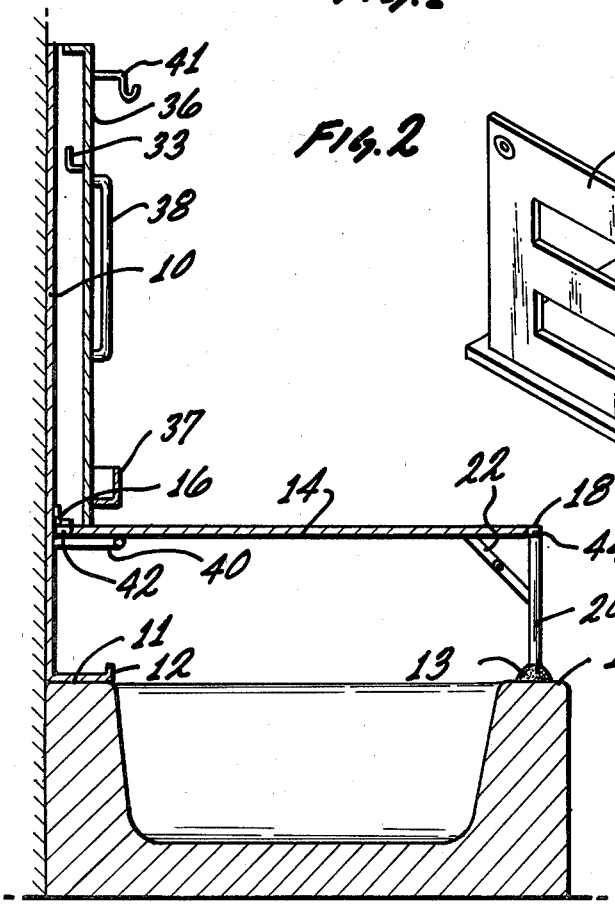
FIG. 2 is a side elevation view of the unit of FIG. 1.

The back rest 28 and the fence members 32 may hang on nails or hooks 33 as shown in FIG. 4 on the inside of a closure cover 36 pivotally secured or hinged at one side directly to the back panel 10 which encloses the entire bench or support assembly in its folded, out-of-the way position. The cover 36 has a depth to receive the back rest and the support bench and to close as shown in FIG. 2.

The cover member 36 can be secured in the closed position by any suitable means such as by magnetic latches and the like. However, more secure latches may be desirable in certain circumstances. For example, a hand rail 38 may be mounted on the front of the door or closure panel 36 and angle upward at an angle. This permits one who may otherwise be unsteady to support themselves by this handrail during bathing and getting in and out of the tub. In addition, a further handrail 40 may be secured directly to the back panel and extending across directly beneath the lower end of the support member 14 to also provide additional support for member 14. Additional fixtures such as a utility tray for soap or the like 37, towel rack 41 hooks 43 and the like are built into the cover or secured thereto as desired. A utility shelf or tray for soap or the like is detachably attached to back panel 10 underneath support and handrail 40.

Preferably, the wall panel is of a strong rigid material and can be made from any number of materials such as plastic covered stainless steel, a rigid, durable plastic, or fiberglass or the like. Similarly, the door cover 36 can be constructed of similar materials.

The bench or support member 14 is preferably constructed of a high strength durable plastic material molded over a reinforcing frame of metal structural members or the like 42 and 44. These structural members may be square tubular steel or the like. This permits the support member to be constructed of light and durable plastic such as polystyrene and yet have a very high support strength. The support surface should be rough to prevent slippage. The support can be supplied in different colors to match other fixtures and the like.

Various adjustments can be made in the height and width of the device to suit the needs of the particular installation.

Figure 5:
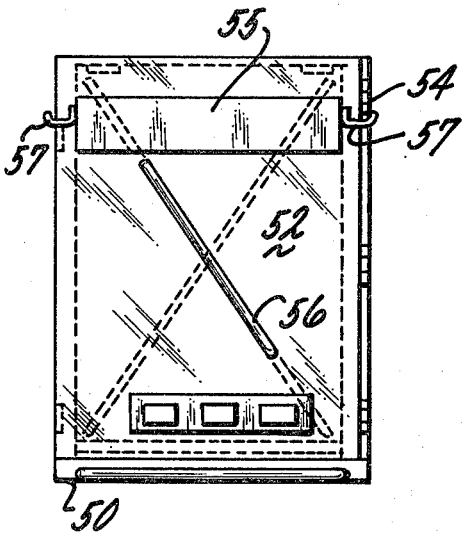
FIG. 5 is a front elevational view of an alternate embodiment adapted for a shower.
Figure 6:
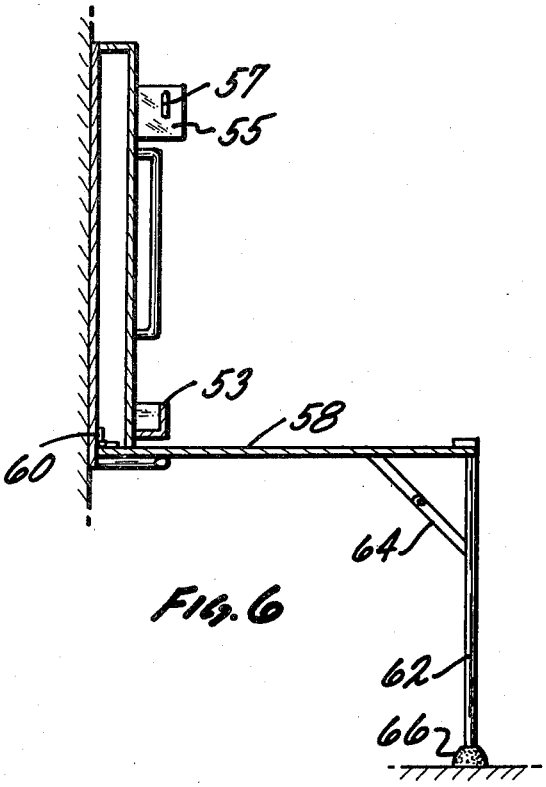
FIG. 6 is a side elevational view of the unit of FIG. 5.

Turning to FIGS. 5 and 6, a support unit similar to that previously described is disclosed comprising a back wall or panel member 50 having an enclosure cover or the like 52 hinged securely along one edge at 54 for example directly to the back panel. This unit is devised and designed for use in a shower and similarly includes a handrail or the like 56 extending at a diagonal or angle to between the horizontal and vertical. The handrail can be either molded directly into the structure or detachably secured thereto. A soap and sponge dish 53 can also be removeably attached to the panel as for easy removal and cleaning. A utility shelf 55 with wash cloths hooks 57 may also be mounted on the front of cover 52.

Folded within the cabinet structure is a generally rectangular support or bench member 58 which is hinged at its inner end by a hinge 60 directly to the wall panel 50 and includes two support legs 62 pivotally connected at the outer ends directly to the support member 58 and includes two hinge bracket or brace members 64. The lower end of the legs, as in the previous embodiment can include rubber suction cup foot members 66 to more securely grip the surface on which the legs or feet rest. This support device cover can similarly be considered a utility panel with the bath accessories or the like such as towel rack, handrail, utility trays soap dishes and the like either molded in or attached to the structure. The unit is mounted on the sidewall of a shower stall facing the door to make it easily accessible to the physically handicapped, particularly those in wheel chairs and for their benefit.

Figure 7:
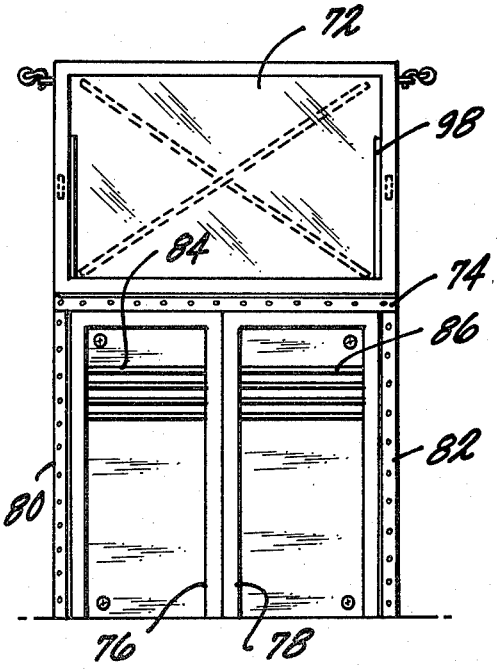
FIG. 7 is a front elevational view of a further embodiment of the invention adapted for a shower.
Figure 8:
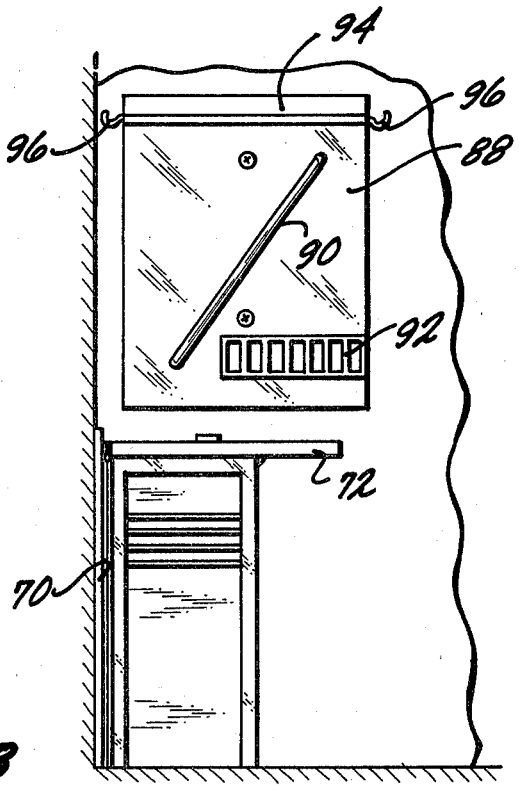
FIG. 8 is a side elevation view of the embodiment of FIG. 7.

Turning now to FIGS. 7 and 8 a still further embodiment is illustrated wherein a back panel 70 includes a support member or seat 72 pivotally secured at 74 by hinges or the like to the wall panel. A pair of support legs or the like 76 and 78 of a generally U-shaped configuration are pivotally secured such as by hinges at 80 and 82 along the side walls or side edges of the panel 70. These fold out as shown in FIG. 8 to support the seat 72 in the opened down position. The seat member 72 is constructed as substantially as previously described and is preferably a reinforced metal frame work molded into a plastic.

One or more utility shelves 84 and 86 may be secured directly to the leg members 76 and 78. An additional wall panel 88 may be secured adjacent to the previously described panel and includes a handrail or the like 90 secured thereto at an angle as illustrated. Further fixtures and the like such as soap dishes 92, towel racks 94, utility hooks 96, and the like may be secured to and supported by this and other panels of the units within the shower. Preferably, this support unit is secured on the wall opposite the shower head in the shower. A cover or closure member (not shown) may also be provided.

Thus, while I have illustrated and described my invention by specific embodiments, it is to be understood that numerous changes and modification may be made therein without departing from the spirit and scope of the invention as defined in the appended claims.

I now claim:

1. A fold away bathing support unit for securing to a bathroom wall adjacent a shower or a tub, comprising in combination:

a flat generally rectangular back panel for attachment directly to a vertical bathroom wall adjacent a shower or tub;

a support member of a generally planar rectangular configuration having an inner end pivotally connected to said back panel at the lower end thereof, said support member having an outer end and a length substantially equal to the width of a standard bath tub, and being pivotal between an upright position against said back panel and an extended outward horizontal support position;

a pair of support legs pivotally mounted on the other end of said support member and pivotable to a support position extending vertically beneath said support member at said outer end for supporting said support member in the horizontally outward support position;

a pair of parallel slots formed in and extending along the edges of said support member for selectively mounting a backrest panel or two fence members;

a generally flat rectangular backrest panel detachably securable to either side of said support member by insertion in a selected one of said slots when said support is in the outward support position and a cover member hinged to a side edge of said back panel to define a vertical hinge axis and being pivotal between a closed position generally parallel to said back panel and an open position to clear the way for said support member to pivot between its upright position and horizontal support position;

said cover having a lower edge terminating short of said support member when the latter is in its horizontal support position such that when the support member is in its horizontal support mode, said cover is free to pivot into its closed position;

said cover mounting a soap dish on a lower portion thereof such that same is accessible by a bather both when the support member is in its horizontal support position and when it is in its stowed upright position with the shower or tub being in normal use; and a handrail securely mounted on said cover and positioned to be usable by the bather with or without the support member being extended in its outward horizontal support position.

2. The support unit of claim 1 including a horizontally extended support and hand rail secured to said back panel just beneath the connection of said support member thereto for defining a hand rail when said support member is in the upright position; and said support member resting on said hand rail such that same supports the inner end of said support member when said support member is in the horizontal position.

3. The support unit of claim 1 wherein said backrest panel defines a pair of spaced apertures, and including at least one elongated fence member dimensioned to be interchangeably insertable in either of said parallel slots in said backrest panel, as said cover defines a pair of hooks on the rear side thereof spaced to engage the spaced apertures in said backrest panel and said fence member having an aperture engageable by one of said hooks whereby said backrest panel and fence member are conveniently engageable and removable from said hooks when said cover is swung out to present said hooks spaced from the wall and conveniently positioned over the bathing area.

4. The support unit of claim 1 wherein said handrail is diagonally mounted such that it slopes down at one end toward the bather, to facilitate gripping the handrail, especially by the physically impaired.

* * * * *